US006580396B2

(12) United States Patent
Lin

(10) Patent No.: US 6,580,396 B2
(45) Date of Patent: Jun. 17, 2003

(54) DUAL-BAND ANTENNA WITH THREE RESONATORS

(75) Inventor: Fang-Lih Lin, Taipei (TW)

(73) Assignee: Chi Mei Communication Systems, Inc., Tan-Nan (TW)

( * ) Notice: Subject to any disclaimer, the term of this patent is extended or adjusted under 35 U.S.C. 154(b) by 0 days.

(21) Appl. No.: 10/063,310

(22) Filed: Apr. 10, 2002

(65) Prior Publication Data

US 2002/0175861 A1 Nov. 28, 2002

(30) Foreign Application Priority Data

May 25, 2001 (TW) ..... 090112707

(51) Int. Cl.[7] ..... H01Q 1/38; H01Q 1/24

(52) U.S. Cl. ..... 343/700 MS; 343/846; 343/702

(58) Field of Search ..... 343/702, 700 MS, 343/846, 829, 830

(56) References Cited

U.S. PATENT DOCUMENTS 6,366,243 B1 * 4/2002 Isohatala et al. ..... 343/702
6,473,044 B2 * 10/2002 Manteuffel et al. ..... 343/702

FOREIGN PATENT DOCUMENTS

| | | |
|---|---|---|
| DE | 199 83 824 T1 | 6/2000 |
| EP | 1 026 774 A2 | 8/2000 |
| EP | 1 079 463 A2 | 2/2001 |
| EP | 1 168 491 A1 | 1/2002 |
| EP | 1 202 386 A2 | 5/2002 |

* cited by examiner

*Primary Examiner*—Michael C. Wimer
(74) *Attorney, Agent, or Firm*—Winston Hsu

(57) ABSTRACT

An antenna comprises a ground plate, a first plate, a connector, and a signal feeder having two terminals respectively electrically connected to the ground plate and the first plate. The first plate is set above the ground plate and comprises first, second, and third resonance regions with respective dimensions corresponding to wavelengths of first, second, and third frequencies at which the antenna operates. A connection region is connected to the first, second, and third resonance regions. The connector has two opposite ends respectively connected to the ground plate and the connection region. The first, second, and third frequencies respectively correspond to first, second, and third frequency bands of the antenna. The second frequency is close to the third frequency such that the second frequency band and the third frequency band are partially overlapped to cause the second frequency band and the third frequency band to merge.

14 Claims, 22 Drawing Sheets

DUAL-BAND ANTENNA WITH THREE RESONATORS

BACKGROUND OF INVENTION

1. Field of the Invention

The invention relates to a dual-band antenna, and more particularly, to a dual-band antenna with three resonators.

2. Description of the Prior Art

Radiotelephones generally refer to communications terminals that provide a wireless communications link to one or more other communications terminals. Radiotelephones are utilized in variety of different applications, including cellular phones, satellite communications systems, and so forth. Radiotelephones typically have an antenna for transmitting and/or receiving wireless communications signals.

Radiotelephones and other wireless communications device are undergoing constant miniaturization. Thus, there is an increased demand in small antennas that can be used as internally mounted antennas for radiotelephones. In addition, it is becoming desirable for radiotelephones to be able to operate within multiple frequency bands in order to utilize more than one communications system. For example, GSM (Global System for Mobile communication) is a digital mobile telephone system that typically operates at a low frequency band, such as between 880 MHz and 960 MHz. DCS (Digital Communications system) is a digital mobile telephone system that typically operates at a high frequency band, such as between 1710 MHz and 1880 MHz. Since there are two different frequency bands, radiotelephone service subscribers who travel over service areas employing different frequency bands may need two separate antennas unless a dual-band antenna is used. Additionally, as the amount of data being sent through wireless communications signals increases, the bandwidth of the frequency band at which the antenna operates is required to increase as well.

Please refer to FIG. 1. FIG. 1 is a perspective view of a prior art antenna 10 disclosed in U.S. Pat. No. 5,926,139. The prior art antenna 10 comprises a conductive ground plate 14, a conductive first plate 12 set above the ground plate 14, a conductive connector 18 having two opposite ends connected to the ground plate 14 and the first plate 12, and a signal feeder 19 having two terminals. One terminal of the signal feeder 19 is a grounded terminal electrically connected to the ground plate 14, and the other terminal is a signal terminal 16 electrically connected to the first plate 12. Data signals, which are transmitted from the antenna 10 or received by the antenna 10 are fed through the signal feeder 19. The connector 18 is a short pin for connecting the first plate 12 and the ground plate 14. For operating within two frequency bands, the first plate 12 of the prior art antenna 10 has two resonating regions 17A, 17B, each corresponding to one frequency band at which the antenna 10 operates. In addition, European Pat. No. EP0997974A1 discloses an antenna that is similar to the antenna 10 having the first plate 12 on which two resonating regions are disposed.

Please refer to FIG. 2. FIG. 2 is a correlation diagram between reflection and frequency of the prior art antenna 10. The horizontal axis represents the frequency, and the vertical axis represents the absolute value of reflection. The reflection of an antenna can be used to evaluate a bandwidth of a frequency band at which the antenna operates. Generally, a frequency range under reflection of −10 decibel (dB) is used to be the frequency band at which the antenna operates. As shown in FIG. 2, the two resonating regions 17A, 17B of the antenna 10 (shown in FIG. 1) respectively correspond to two frequency bands A1, A2 of the antenna 10 distributed around frequencies fa, fb so that the antenna 10 can operate within the two frequency bands A1, A2.

Since the prior art antenna 10 is planar, it is very suitable for embedding into portable wireless communications devices, such as a cellular phone, so as to rid the device of protruding antennas. However, the prior art antenna 10 has a disadvantage of narrow bandwidth, especially a narrow bandwidth at a higher frequency. For example, the specification of a frequency band distributed around 1800 MHz must have a bandwidth of 170 MHz. However, the antenna 10 with regular dimensions does not have enough bandwidth to meet the requirements of a digital mobile phone system that operates at a frequency band of 1800 MHz. Thus, in order to increase the bandwidth of the antenna 10, the dimensions of its corresponding resonating region are required to be enlarged. Unfortunately, enlarging the dimension of the resonating region will expand the physical area and the physical volume of the antenna 10. Expanding the size in this way will adversely affect the ability to miniaturize a cellular phone.

SUMMARY OF INVENTION

It is therefore a primary objective of the claimed invention to provide a dual-band antenna with three resonators to solve the above-mentioned problem.

According to the claimed invention, the antenna comprises a conductive ground plate, a conductive first plate, a conductive connector, and a signal feeder. The conductive first plate is set above the ground plate, and a fixed distance separates the first plate and the ground plate. The first plate comprises first, second, and third resonance regions with respective dimensions corresponding to wavelengths of first, second, and third frequencies at which the antenna operates. The first plate also comprises a connection region connected to the first, the second, and the third resonance regions. The conductive connector has two opposite ends respectively connected to the ground plate and the connection region. The signal feeder has two terminals respectively electrically connected to the ground plate and the first plate. The first, the second, and the third frequencies are different and respectively correspond to first, second, and third frequency bands of the antenna. The second frequency is close to the third frequency such that the second frequency band and the third frequency band are partially overlapped to cause the second frequency band and the third frequency band to merge.

It is an advantage of the claimed invention that the dual-band antenna with three resonators is capable of substantially broadening the bandwidth to overcome the prior art shortcomings.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
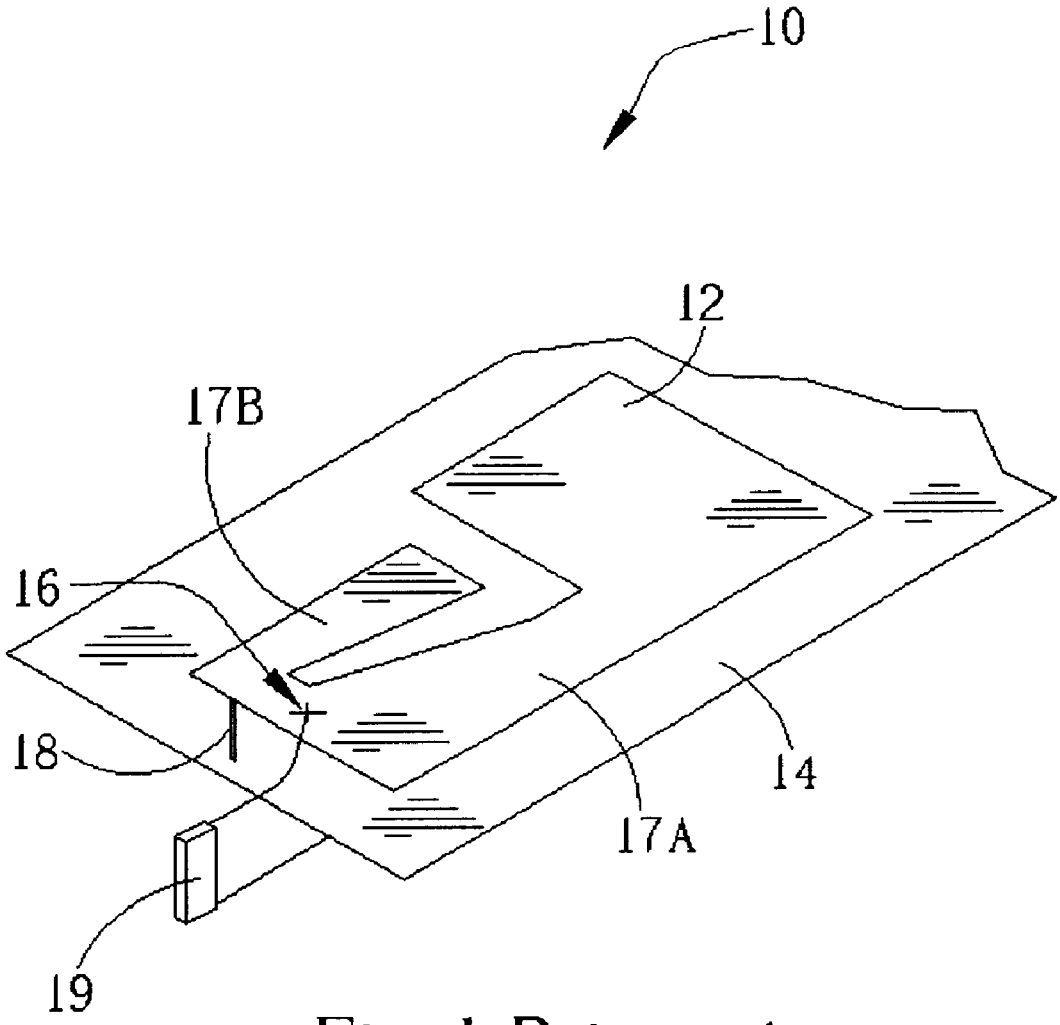
Fig. 1 Prior art
FIG. 1 is a perspective view of an antenna according to the prior art.
Figure 2:
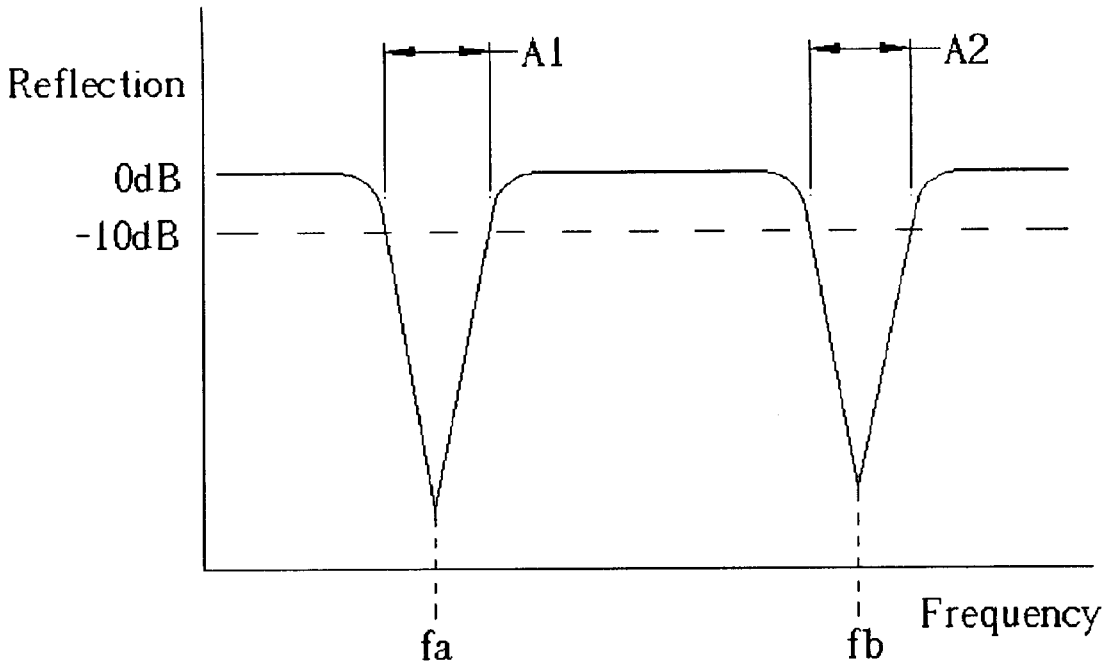
Fig. 2 Prior art
FIG. 2 is a correlation diagram between reflection and frequency of the antenna shown in FIG. 1.
Figure 3A:
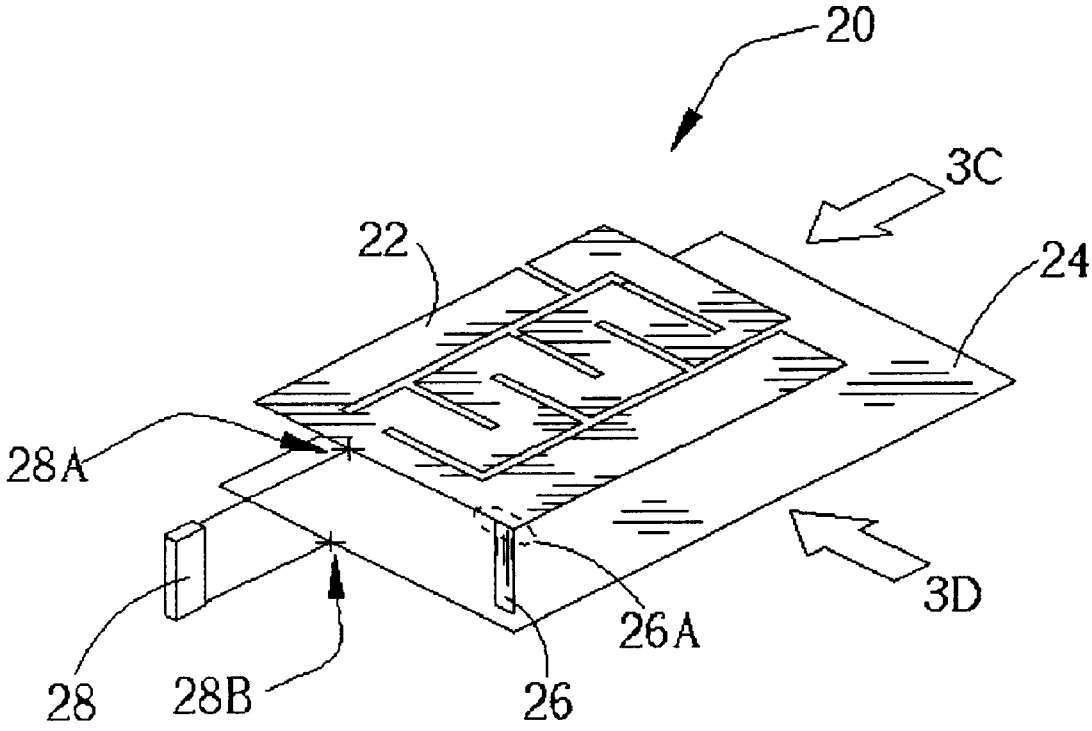
FIG. 3A is a perspective view of an antenna according to one embodiment of the present invention.
Figure 3B:
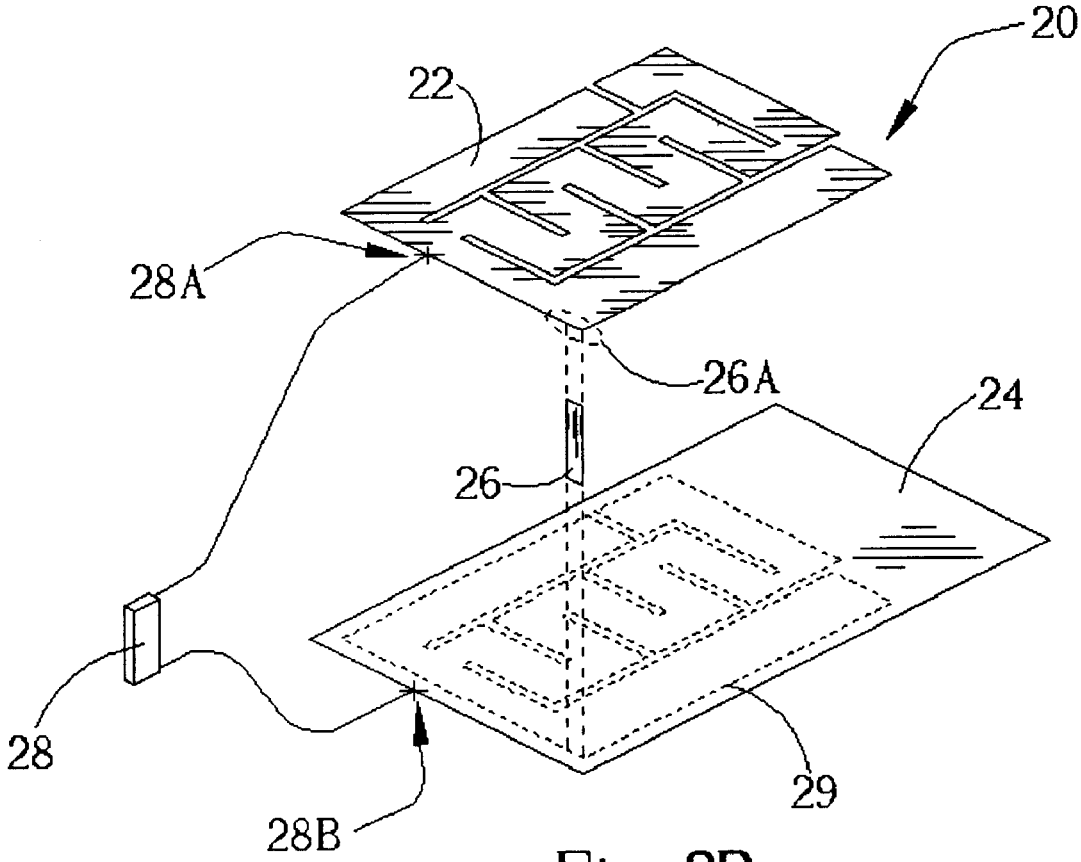
FIG. 3B is an exploded view of the antenna shown in FIG. 3A.
Figure 3C:
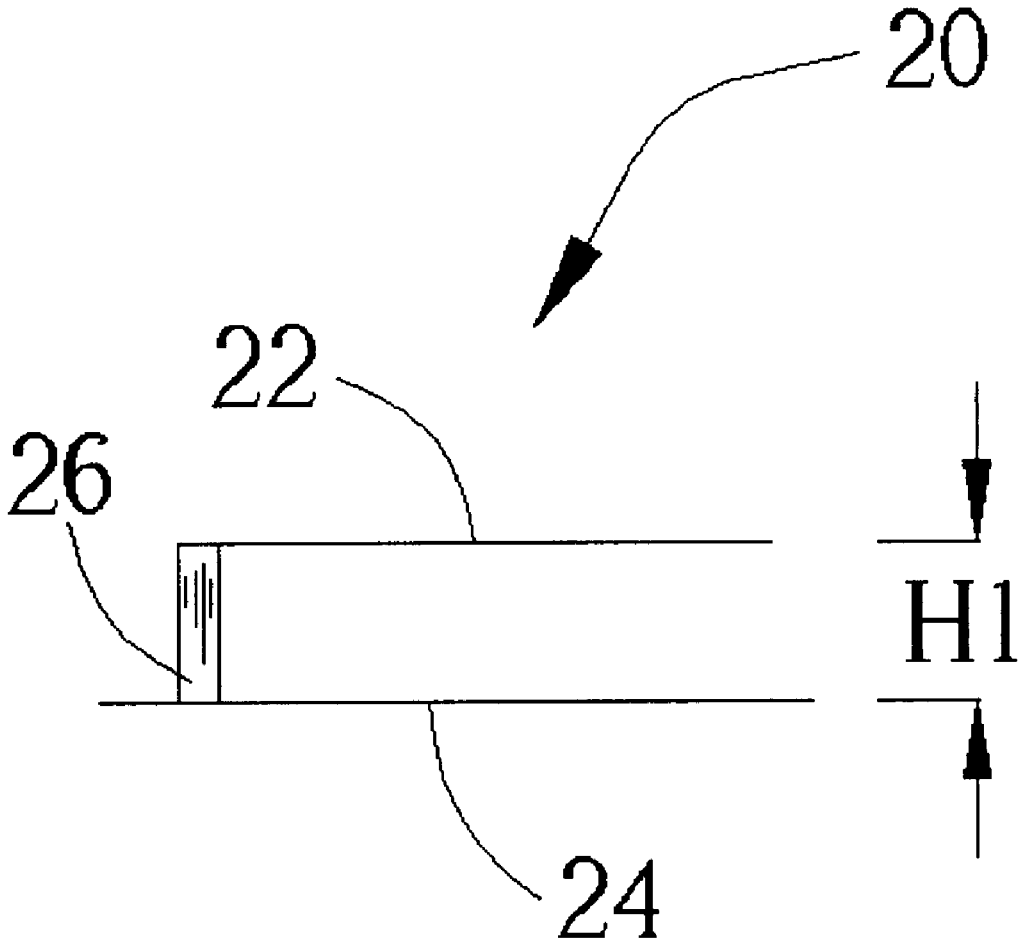
FIG. 3C is a side view of the antenna shown in FIG. 3A.
Figure 3D:
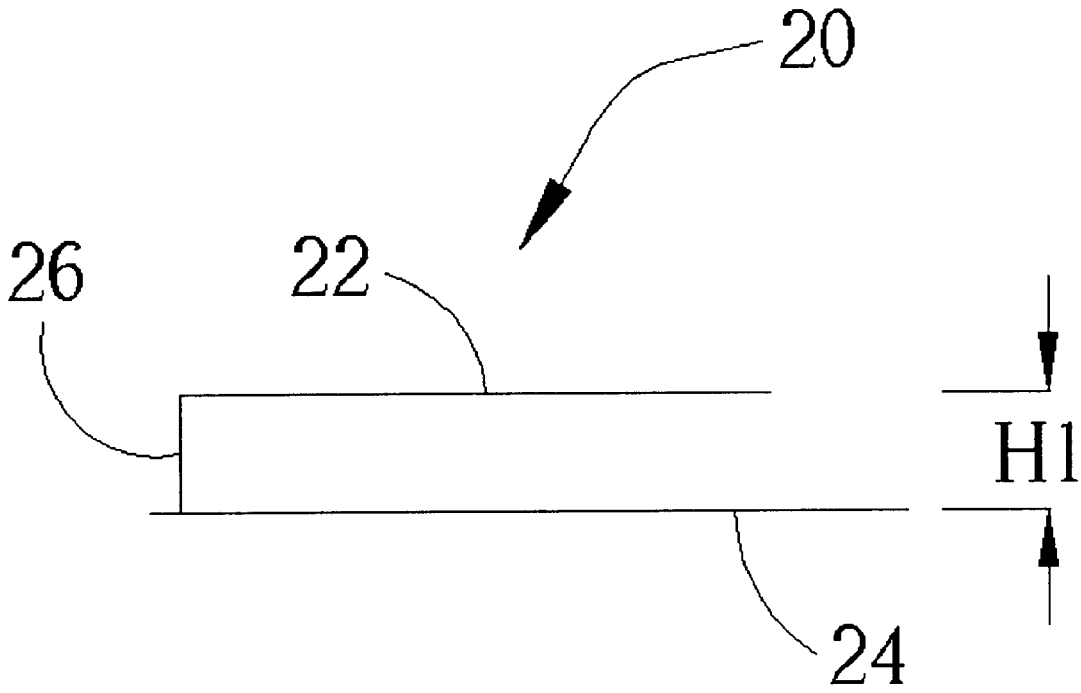
FIG. 3D is an alternative side view of the antenna shown in FIG. 3A.

Please refer to FIGS. 3A to 3D. FIG. 3A is a perspective view of an antenna 20 according to one embodiment of the present invention. FIG. 3B is an exploded view of the antenna 20. FIG. 3C is a side view of the antenna 20 from a direction 3C shown in FIG. 3A. FIG. 3D is a side view of the antenna 20 from a direction 3D shown in FIG. 3A. The antenna 20 comprises a conductive first plate 22 and a conductive ground plate 24 which are parallel to each other. As shown in FIGS. 3C and 3D, a fixed distance H1 separates the first plate 22 and the ground plate 24. A conductive connector 26 set between the ground plate 24 and the first plate 22 is used as a short pin and has two opposite ends respectively connected to the first plate 22 and the ground plate 24. A contact end 26A designated by a dotted circle in FIGS. 3A and 3B is a connection point connecting the first plate 22 and the connector 26. A dotted line 29 shown in FIG. 3B designates the position of the first plate 22 projected on the ground plate 24.

Additionally, the antenna 20 further comprises a signal feeder 28 having two terminals respectively electrically connected to a contact 28A on the first plate 22 and a contact 28B on the ground plate 24. Signals transmitted from the antenna 20 or received by the antenna 20 are fed through the signal feeder 28. In some portable wireless communications devices, a printed circuit board (PCB) of an internal circuit, which includes a signal feeder of an antenna as well, has a ground plate. In this case, the antenna of the present invention can utilize the ground plate of the PCB to be the ground plate of the antenna. Meanwhile, the other contact of the signal feeder 28 is still electrically connected to the contact 28A on the first plate 22.

Figure 3E:
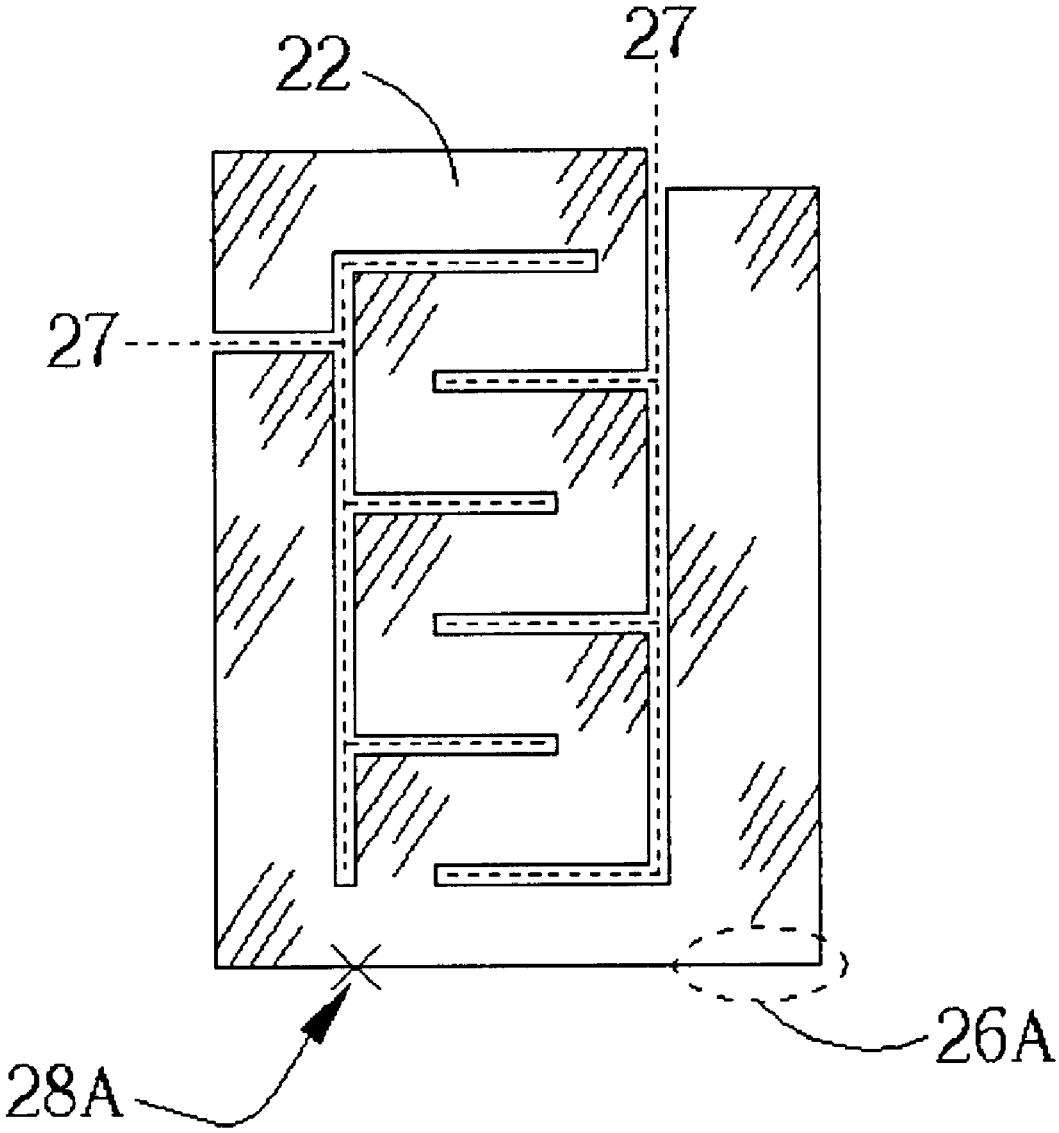
FIG. 3E is a top view of a first plate of the antenna shown in FIG. 3A.
Figure 3F:
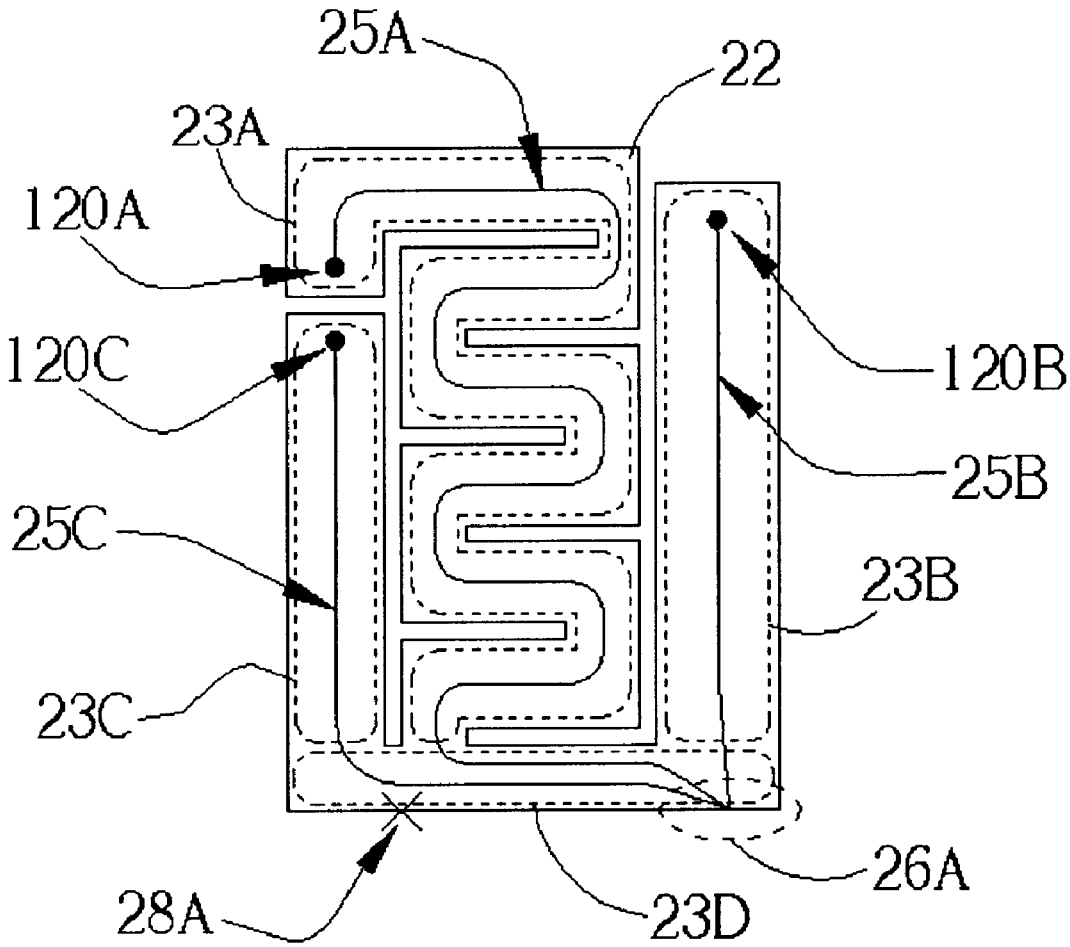
FIG. 3F is a schematic configuration diagram of the first plate of the antenna shown in FIG. 3A.

For further describing the first plate 22 of the antenna 20, please refer to FIGS. 3E and 3F. FIG. 3E is a top view of the first plate 22 of the antenna 20. FIG. 3F is a schematic diagram of each region on the first plate 22 of the antenna 20. Slots 27, which are designated by dotted lines shown in FIG. 3E, separate each region on the first plate 22. As shown in FIG. 3F, four dotted circles designate locations of four regions, which are a first resonance region 23A, a second resonance region 23B, a third resonance region 23C, and a connection region 23D. As shown in FIGS. 3E and 3F, the first resonance region 23A, the second resonance region 23B, and the third resonance region 23C are separated by the slots 27 and connected to the connection region 23D simultaneously. Furthermore, both the contact end 26A on the first plate 22, which connects to the connector 26, and the contact 28A electrically connected to the signal feeder 28 are disposed on the connection region 23D.

The first resonance region 23A, the second resonance region 23B, and the third resonance region 23C have respective dimensions corresponding to wavelengths of first, second, and third frequencies at which the antenna 20 operates. Explicitly speaking, in the first resonance region 23A, a current fed from the signal feeder 28 to the ground plate 24 flows to the contact end 26A of the first plate 22 through the connector 26. Thereafter, the current flows through the connection region 23D to a first end 120A of the first resonance region 23A (as a path 25A shown in FIG. 3F). The distance between the first end 120A and an opposite end of the first resonance region 23A is one quarter of the wavelength corresponding to the first frequency. Likewise, in the second resonance region 23B, a current flows through the ground plate 24, the connector 26, the contact end 26A, the connection region 23D, and the second resonance region 23B to the second end 120B of the second resonance region 23B (as a path 25B shown in FIG. 3F). The distance between the second end 120B and an opposite end of the second resonance region 23B is one quarter of the wavelength corresponding to the second frequency. In the third resonance region 23C, the length of a path 25C between a third end 120C and an opposite end of the third resonance region 23C is one quarter of the wavelength corresponding to the third frequency.

Figure 4:
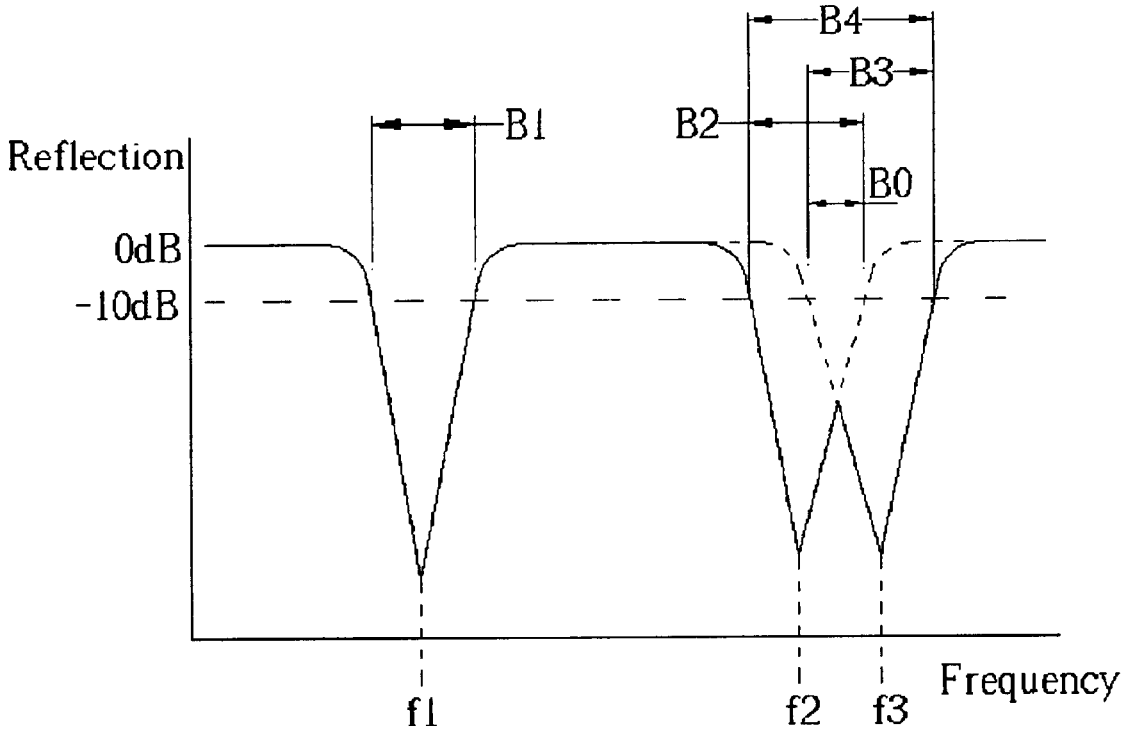
FIG. 4 is a correlation diagram between reflection and frequency of the antenna according to the present invention.

In regard to the working principle of the antenna 20, please refer to FIG. 4. FIG. 4 is a correlation diagram between reflection and frequency of the antenna 20 according to the present invention. As described previously, a frequency range under reflection of −10 decibel (dB) is capable of being used as a frequency band at which an antenna operates. As shown in FIG. 4, according to the present invention, the antenna 20 has the first, the second, and the third resonance regions 23A, 23B, 23C respectively corresponding to first, second, and third frequency bands B1, B2, B3 at which the antenna 20 operates. Additionally, the first, the second, and the third frequency bands B1, B2, B3 are respectively represented by a first, a second, and a third frequency f1, f2, f3. According to this embodiment of the present invention, the frequency difference between the second frequency f2 and the third frequency f3 is substantially smaller than a half of the summation of bandwidths of the second frequency band B2 and the third frequency band B3. Also, the frequency difference between the first frequency f1 and the second frequency f2 is larger than the bandwidth of the first band B1, and the frequency difference between the first frequency f1 and the third frequency f3 is larger than the bandwidth of the first band B1. Additionally, the first frequency f1 is substantially in the range of 800 MHz to 1000 MHz, the second frequency f2 is substantially in the range 1600 MHz to 1799 MHz, and the third frequency f3 is substantially in the range of 1800 MHz to 2000 MHz. The second frequency f2 is approximately in the middle of the second frequency band B2, and the third frequency f3 is approximately in the middle of the third frequency band B3.

In designing the antenna 20 according to the present invention, dimensions of each resonance region can be modified appropriately to adjust the frequencies f1, f2, f3 such that the first frequency band B1 is separated from the second and the third frequency bands B2, B3. The frequency band B1 is used as a first frequency band at which the antenna 20 operates. The frequency bands B2, B3, which correspond to the frequencies f2, f3, are partially overlapped as shown in a frequency range designated by B0 in FIG. 4. The overlapped frequency range B0 merges the second frequency band B2 and the third frequency band B3 so as to form a frequency band B4 with a broader bandwidth than bandwidths of the frequency bands B2, B3. The frequency band B4 is a second frequency band at which the antenna 20 operates. Therefore, the antenna 20 of the present invention can be used in two different frequency bands and broadens the bandwidth of the frequency band effectively, especially the bandwidth of the frequency band with a higher frequency. As described previously, since the demand for the bandwidth of the frequency band with a higher frequency is higher, that is to say, the bandwidth of the frequency band with a higher frequency is required to be broader, the prior art planar antenna has difficulty in meeting the requirement of the bandwidth. In contrast, the planar antenna of the present invention can merge two frequency bands to broaden the bandwidth of the frequency band with the high frequency at which the antenna operates so as to solve the prior art shortcomings.

Figure 5:
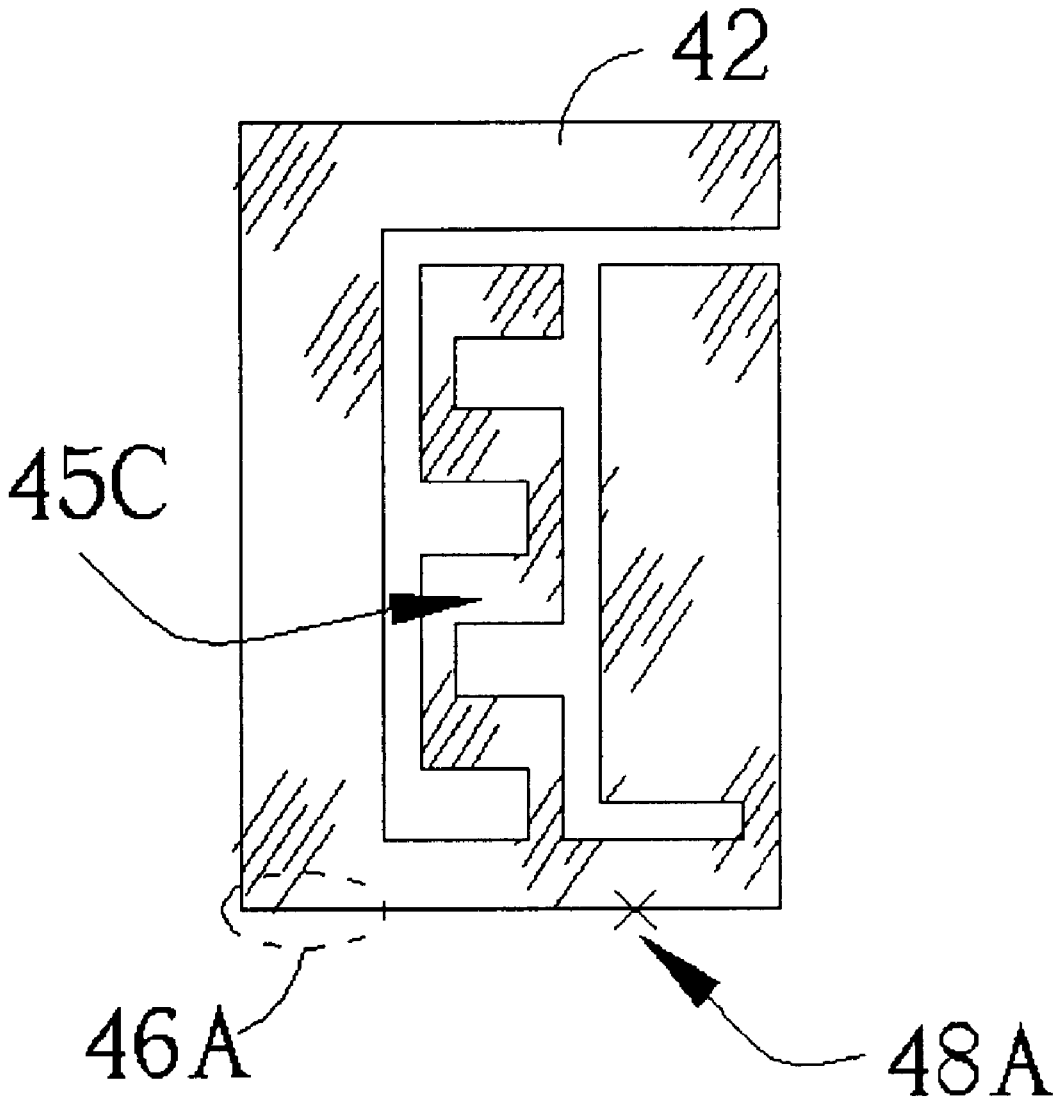
FIGS. 5 to 10 are respective top views of first plates of the antenna according to six different embodiments of the present invention.

Please refer to FIGS. 5 to 10. FIGS. 5 to 10 are respective top views of first plates of the antenna 20 according to six different embodiments of the present invention. Each first plate is divided into three resonance regions by slots. Incidentally, widths of the slots correlate with the coupling of electrical characteristics between each resonance region. Changing the widths of the slots can modulate the characteristics of the antenna, such as a bandwidth of a frequency band, the impedance of the antenna, and so forth. Like the first plate 22 in FIG. 3E, a first plate 42 in FIG. 5 is connected to the connector 26 at a contact end 46A, and is electrically connects to the signal feeder 28 at a contact 48A. Among three resonance regions of the first plate 42, a resonance region 45C is curved so as to increase the length of a current path in the resonance region 45C, thus modulating the corresponding frequency and the corresponding bandwidth of the frequency band in the resonance region 45C.

Figure 6:
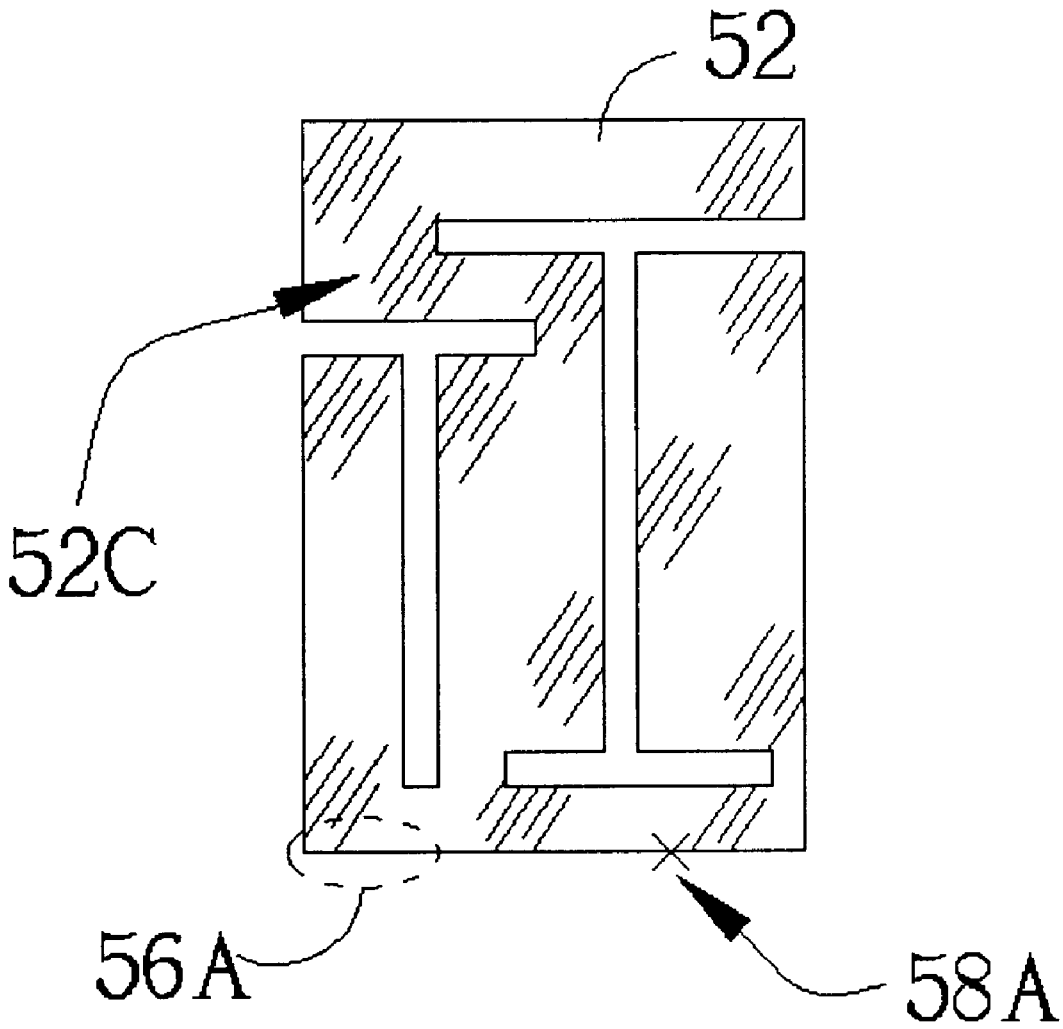

A first plate 52 in FIG. 6 has a contact end 56A and a contact 58A. A resonance region 52C of the first plate 52 is also curved so as to increase the length of a current path in the resonance region 52C, thus modulating the corresponding frequency and the corresponding characteristics of the frequency band in the resonance region 52C. A curved resonance region can change the length of a current path within a fixed area and can increase adjustable parameters in designing an antenna so as to optimize the performance of the antenna.

Figure 7:
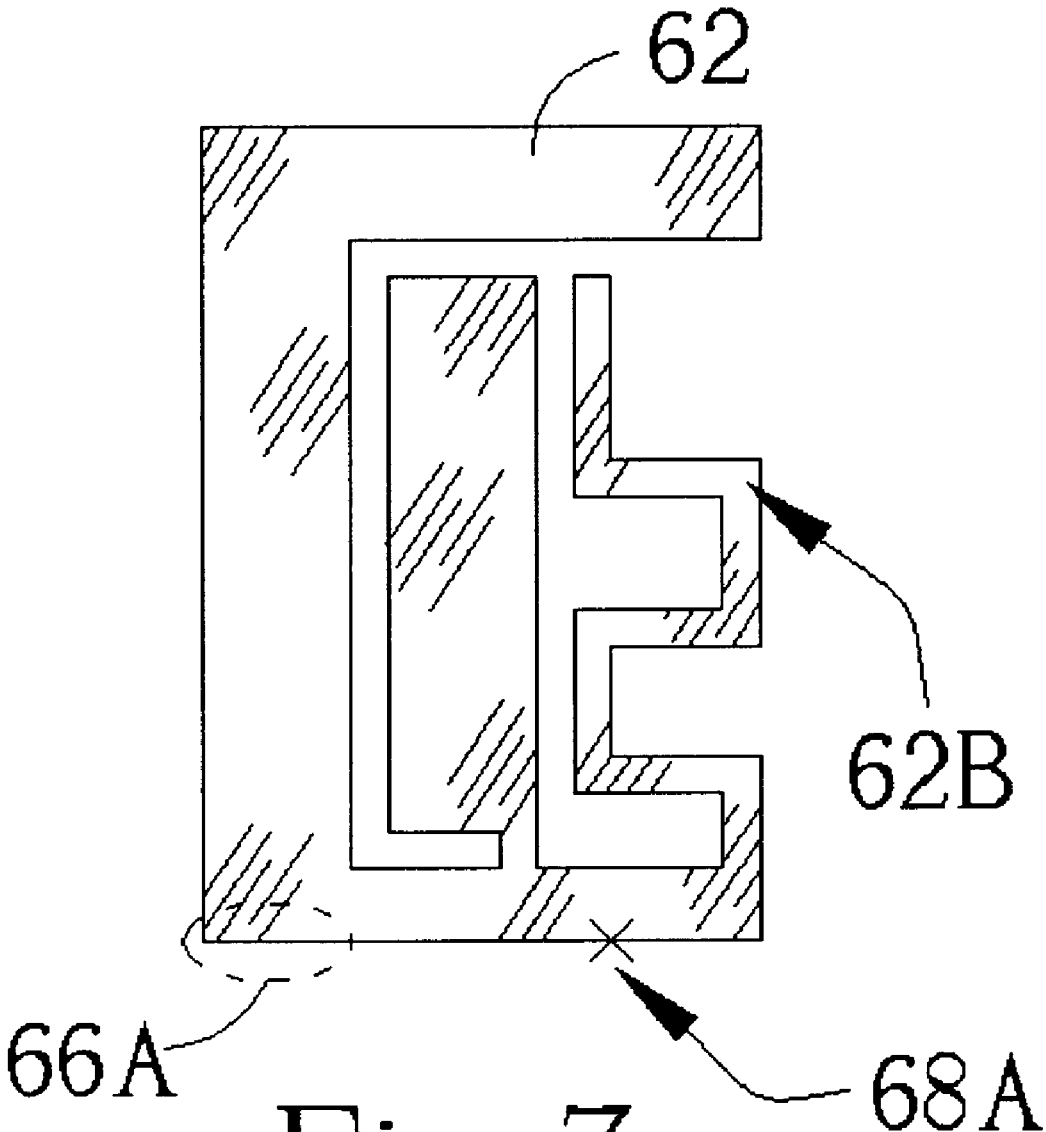
Figure 8:
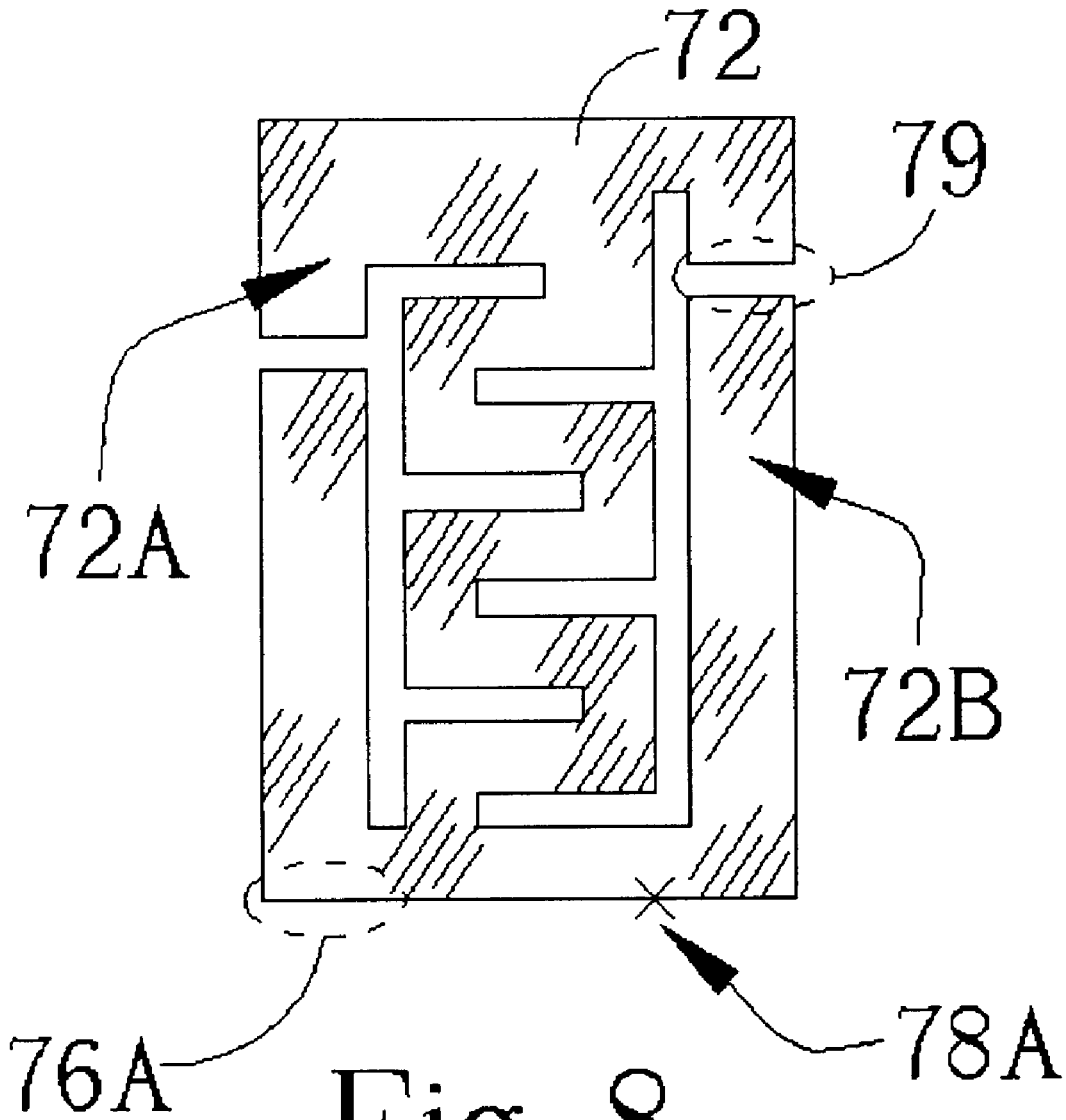
Figure 9:
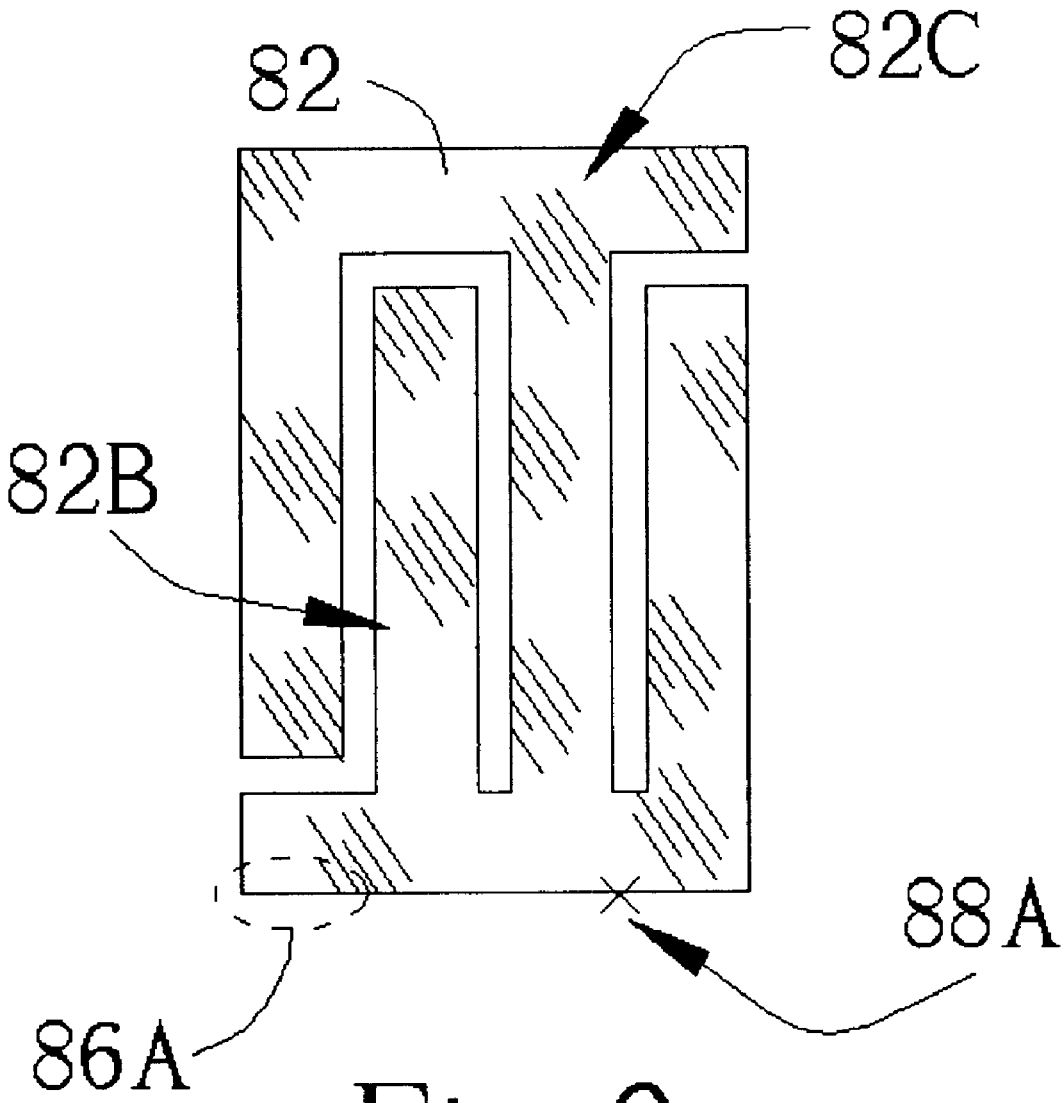
Figure 10:
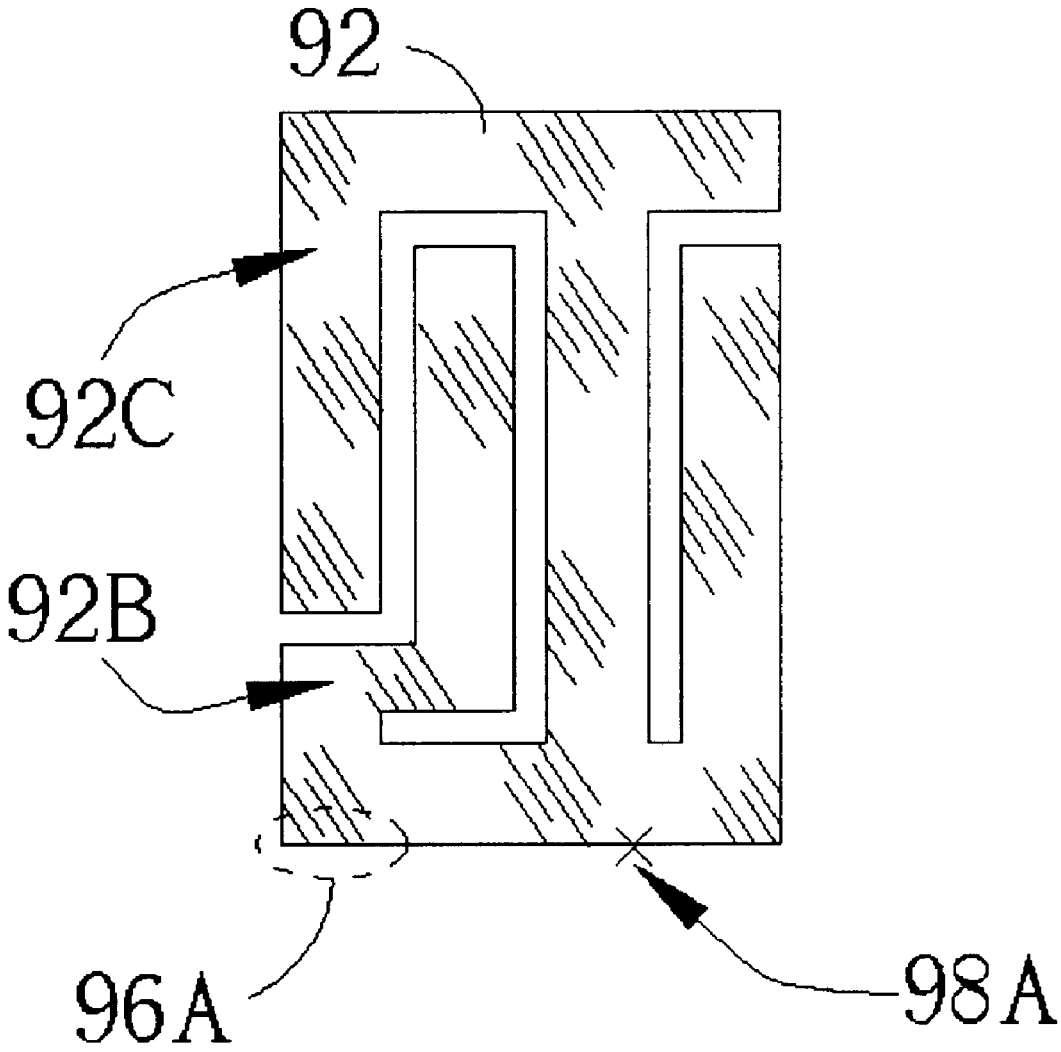

Similarly, a first plate 62 in FIG. 7 has a contact end 66A, a contact 68A, and a curved resonance region 62B. A first plate 72 in FIG. 8 also has a contact end 76A, a contact 78A, and a curved resonance region 72A. The first plate 72 is similar to the first plate 22 in FIG. 3F, except for the state of the end of the resonance region. That is, the second end 120B of the second resonance region 23B in FIG. 3F is open outward, but an end of the resonance region 72B of the first plate 72 is open toward the other resonance region 72A as designated by a dotted circle 79 in FIG. 8. Changing a distance between the resonance regions 72A, 72B, i.e., a width of a slot that separates the two regions 72A, 72B, can modulate the corresponding characteristics of the antenna. A first plate 82 in FIG. 9 has a contact end 86A, a contact 88A, and a curved resonance region 82C that surrounds a resonance region 82B. A first plate 92 in FIG. 10 has a contact end 96A, a contact 98A, and curved resonance regions 92B, 92C. The resonance region 92C partially surrounds the resonance region 92B.

Figure 11A:
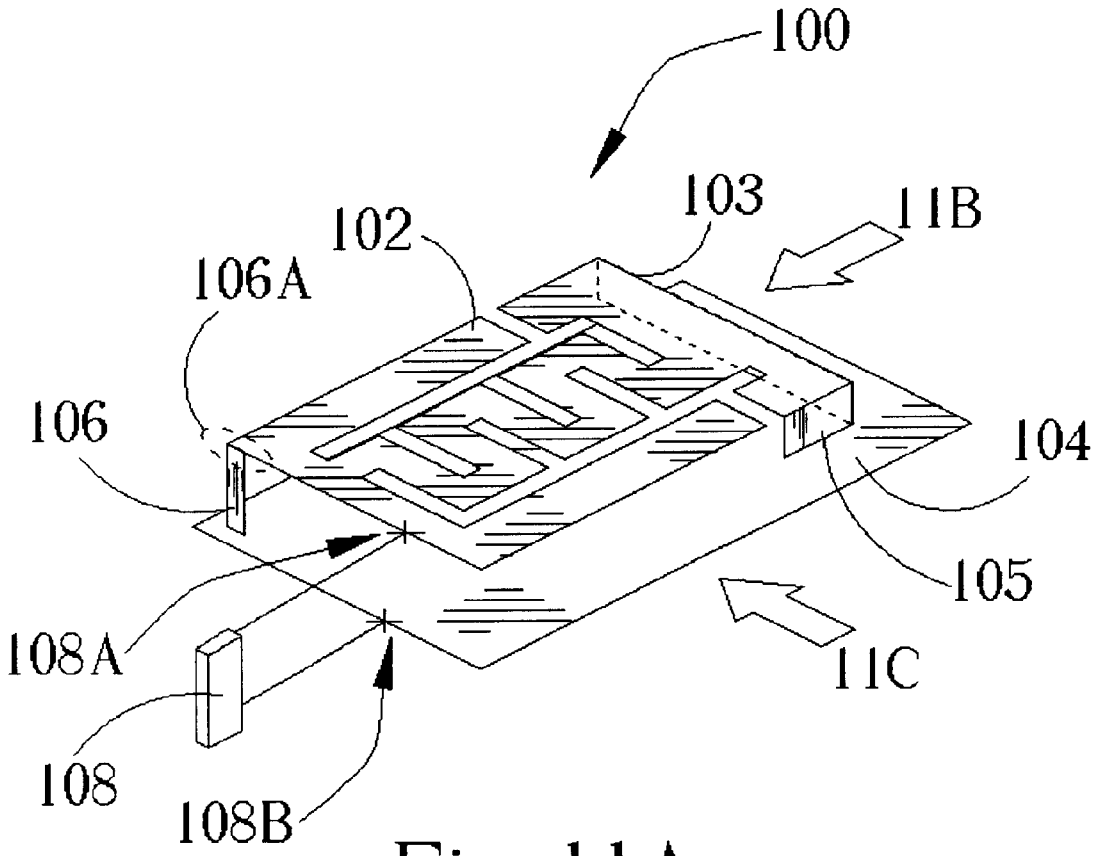
FIG. 11A is a perspective view of an antenna according to an alternative embodiment of the present invention.

Please refer to FIG. 11A. FIG. 11A is a perspective view of an antenna 100 according to an alternative embodiment of the present invention. Like the antenna 20 of the first embodiment of the present invention, the antenna 100 comprises a first plate 102, a ground plate 104, a connector 106, and a signal feeder 108. The connector 106 has two opposite ends respectively connected to the first plate 102 at a contact end 106A, and to the ground plate 104. The signal feeder 108 has two terminals respectively electrically connected to the first plate 102 at a contact 108A, and to the ground plate 104 to be grounded. Differing from the antenna 20, the first plate 102 of the antenna 100 has two conductive extended portions 103, 105 bent downward to be perpendicular to the first plate 102.

Figure 11B:
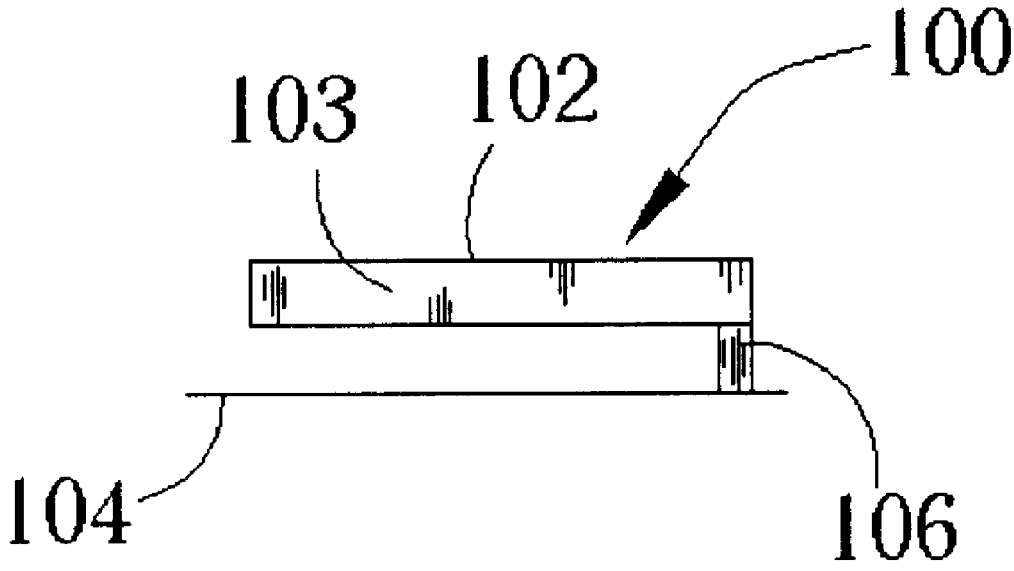
FIG. 11B is a side view of the antenna shown in FIG. 11A.
Figure 11C:
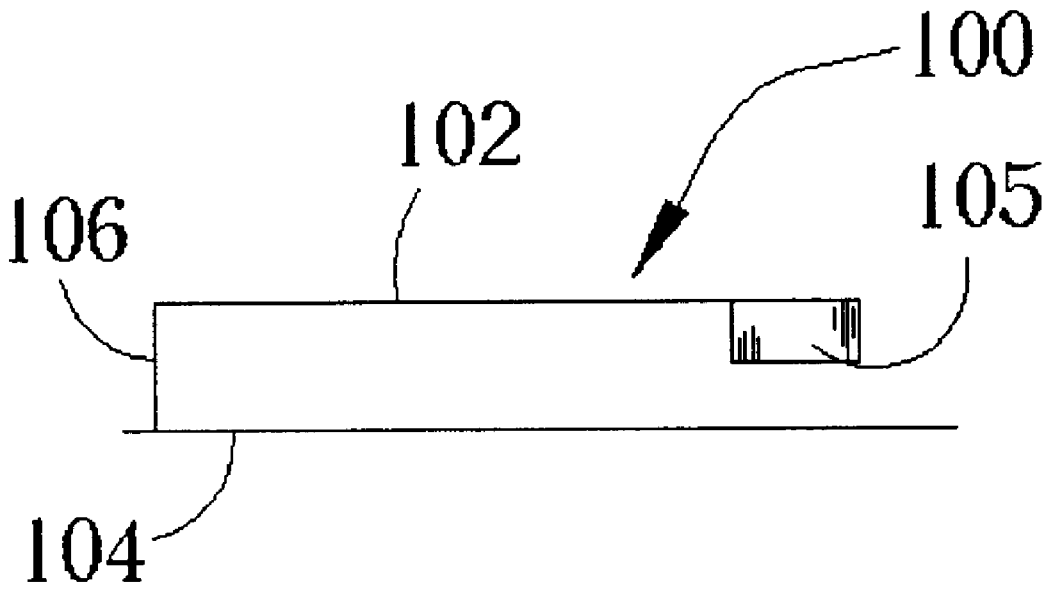
FIG. 11C is an alternative side view of the antenna shown in FIG. 11A.
Figure 11D:
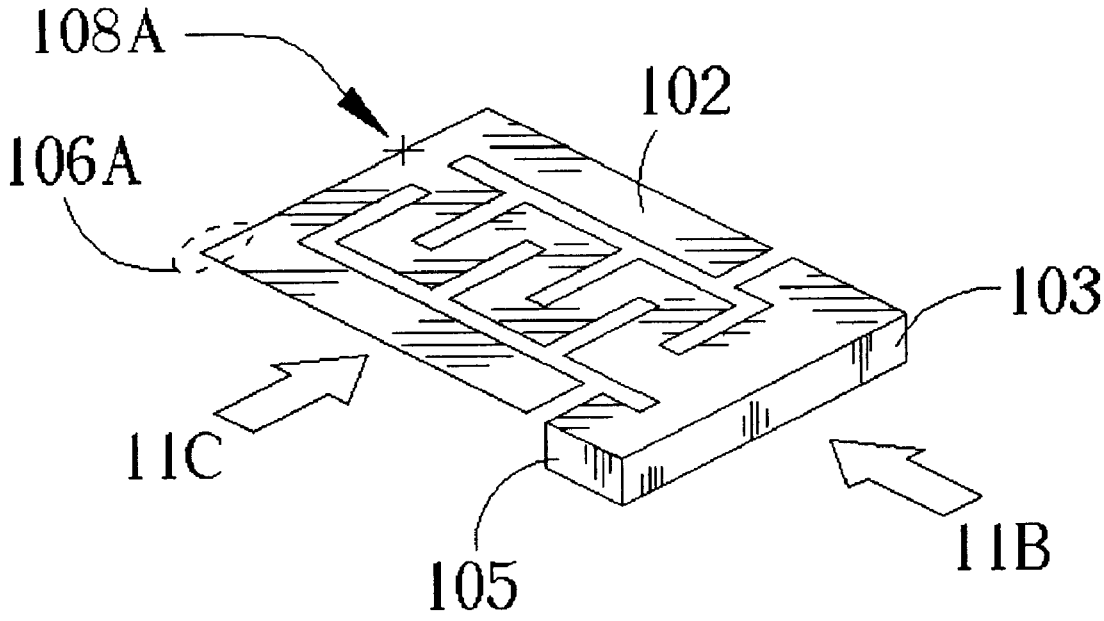
FIG. 11D is a three-dimensional diagram of a first plate of the antenna shown in FIG. 11A.

Please refer to FIGS. 11B to 11D to further disclose the arrangement of the extended portions 103, 105. FIG. 11B is a side view of the antenna 100 from a direction 11B shown in FIG. 11A. FIG. 11C is an alternative side view of the antenna 100 from a direction 11C shown in FIG. 11A. FIG. 11D is a three-dimensional diagram of the first plate 102 of the antenna 100. As shown in FIGS. 11B and 11C, the extended portions 103, 105 do not contact with or connect to the ground plate 104. The purpose of adding the extended portions 103, 105 is to increase the length of a current path in a resonance region so as to modulate the corresponding frequency and the corresponding bandwidth of the frequency band. Adding the extended portions 103, 105 can change the corresponding characteristics of the antenna 100 without increasing the projection area of the first plate 102 so as to reduce the volume of the antenna 100.

Figure 12A:
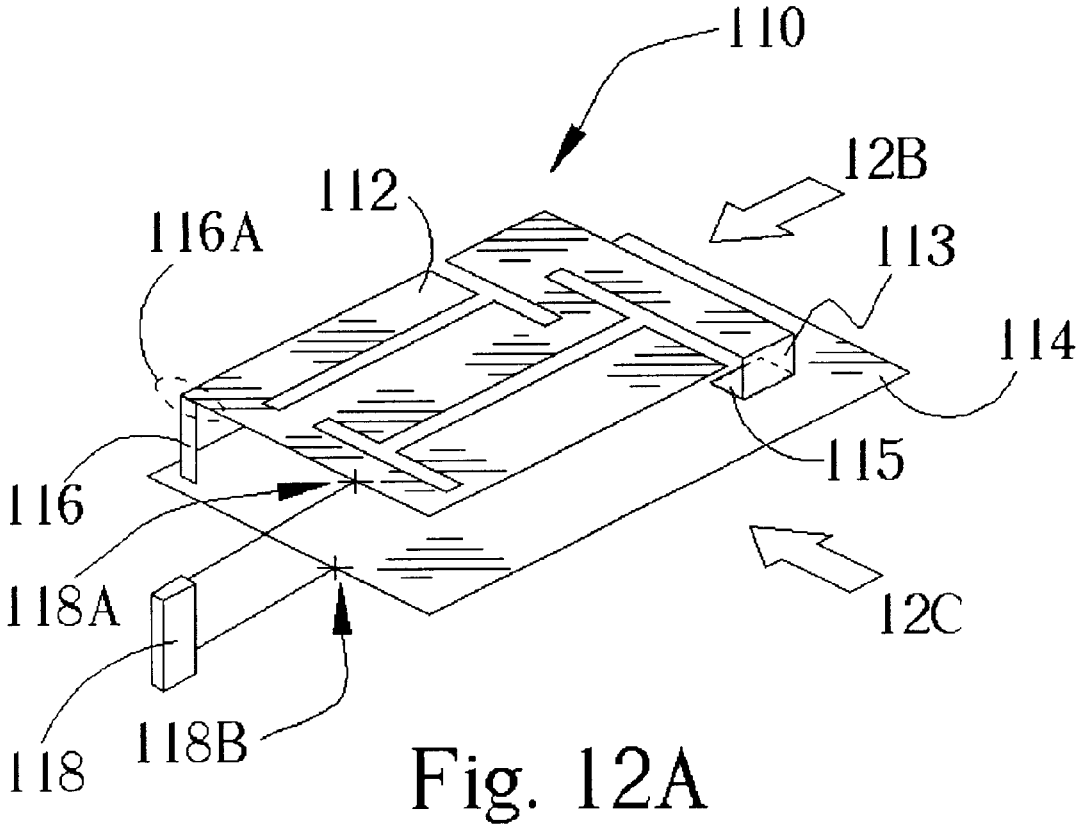
FIG. 12A is a perspective view of an antenna according to a further alternative embodiment of the present invention.

Please refer to FIG. 12A. FIG. 12A is a perspective view of an antenna 110 according to a further alternative embodiment of the present invention. The antenna 110 comprises a first plate 112, a ground plate 114, a connector 116, and a signal feeder 118. The connector 116 has two opposite ends respectively connected to the first plate 112 at a contact end 116A, and to the ground plate 114. The signal feeder 118 has two terminals respectively electrically connected to the first plate 112 at a contact 118A, and to the ground plate 114 to be grounded. Differing from the antenna 100, the first plate 112 of the antenna 110 has an extended portion 113 bent downward to be perpendicular to the first plate 112, and an extended portion 115 connected to the extended portion 113 and bent inward horizontally.

Figure 12B:
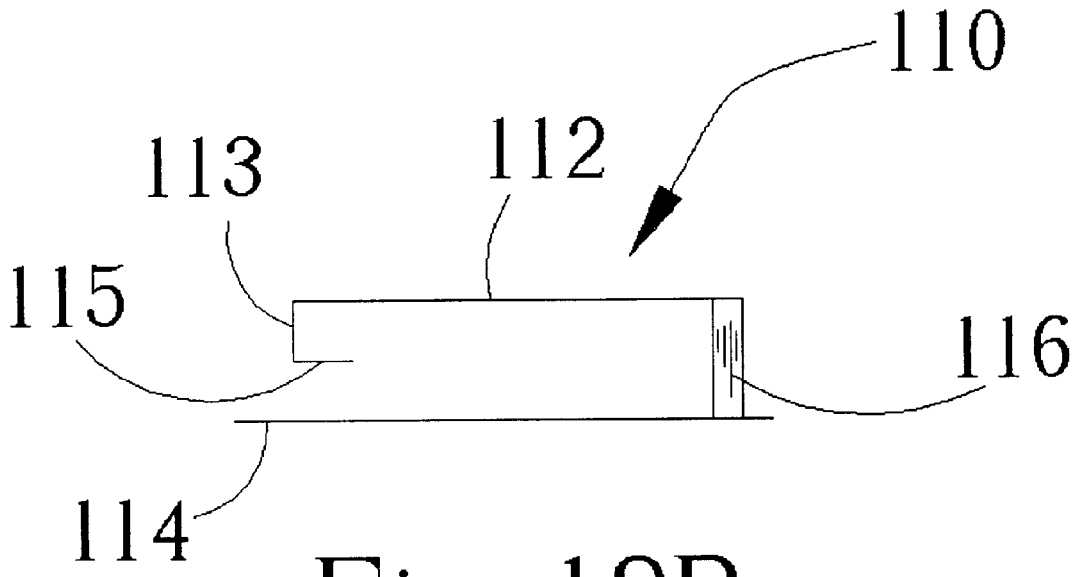
FIG. 12B is a side view of the antenna shown in FIG. 12A.
Figure 12C:
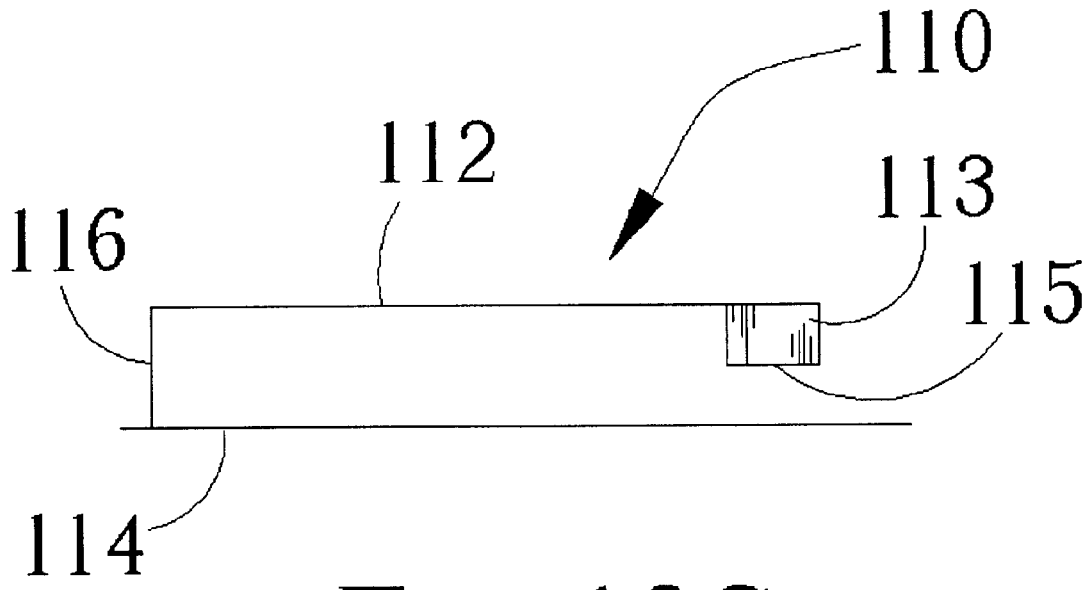
FIG. 12C is an alternative side view of the antenna shown in FIG. 12A.

Please refer to FIGS. 12B and 12C to further disclose the arrangement of the extended portions 113, 115. FIG. 12B is a side view of the antenna 110 from a direction 12B shown in FIG. 12A. FIG. 12C is an alternative side view of the antenna 110 from a direction 12C shown in FIG. 12A. The extended portions 113, 115 do not contact with the ground plate 114. The purpose of the extended portions 113, 115 is to change the length of a current path in a resonance region so as to modulate the corresponding frequency and the corresponding bandwidth of the frequency band.

In contrast to the prior art, the antenna according to the present invention provides three frequency bands and merges two of these three frequency bands into a frequency band with a broader bandwidth so as to solve the problem of the narrow bandwidth of the prior art antenna. Meanwhile, several embodiments disclosed previously provide several parameter modulations so as to optimize the performance of the antenna. Furthermore, other factors can be modified to optimize the performance of the antenna as well such as the position of the contact end at which the connector and the first plate connects, the distance between the first plate and the ground plate, i.e., the length of the connector, and the position of the contact at which the first plate and the signal feeder connects. Moreover, instead of the dielectric material in the preferred embodiments being air, other insulating material can be used as the dielectric material filled between the first plate and the ground plate.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An antenna comprising:

a conductive ground plate;

a conductive first plate set above the ground plate, a fixed distance separating the first plate and the ground plate, the first plate comprising:

first, second, and third resonance regions with respective dimensions corresponding to wavelengths of first, second, and third frequencies at which the antenna operates; and a connection region connected to the first, the second, and the third resonance regions;

a conductive connector having two opposite ends respectively connected to the ground plate and the connection region; and a signal feeder having two terminals respectively electrically connected to the ground plate and the first plate;

wherein the first, the second, and the third frequencies are different, the first, the second, and the third frequencies respectively corresponding to first, second, and third frequency bands of the antenna, the second frequency being close to the third frequency such that the second frequency band and the third frequency band are partially overlapped to cause the second frequency band and the third frequency band to merge.

2. The antenna of claim 1, wherein the first, the second, and the third resonance regions of the first plate are separated by slots.

3. The antenna of claim 1, wherein a first end of the first resonance region connects the first resonance region to the connection region, the distance between the first end and an opposite end of the first resonance region being one quarter of the wavelength corresponding to the first frequency.

4. The antenna of claim 1, wherein a second end of the second resonance region connects the second resonance region to the connection region, the distance between the second end and an opposite end of the second resonance region being one quarter of the wavelength corresponding to the second frequency.

5. The antenna of claim 1, wherein a third end of the third resonance region connects the third resonance region to the connection region, the distance between the third end and an opposite end of the third resonance region being one quarter of the wavelength corresponding to the third frequency.

6. The antenna of claim 1, wherein the first, the second or the third resonance regions further comprise an extended portion bent perpendicular to the first plate.

7. The antenna of claim 1, wherein the frequency difference between the second frequency and the third frequency is substantially smaller than a half of the summation of bandwidths of the second frequency band and the third frequency band.

8. The antenna of claim 1, wherein the frequency difference between the first frequency and the second frequency is larger than the bandwidth of the first band.

9. The antenna of claim 1, wherein the frequency difference between the first frequency and the third frequency is larger than the bandwidth of the first band.

10. The antenna of claim 1, wherein the first frequency is substantially in the range of 800 MHz to 1000 MHz.

11. The antenna of claim 1, wherein the second frequency is substantially in the range 1600 MHz to 1799 MHz.

12. The antenna of claim 11, wherein the second frequency is approximately in the middle of the second frequency band.

13. The antenna of claim 1, wherein the third frequency is substantially in the range of 1800 MHz to 2000 MHz.

14. The antenna of claim 13, wherein the third frequency is approximately in the middle of the third frequency band.

* * * * *